United States Patent [19]

Genthe

[11] 4,360,262

[45] Nov. 23, 1982

[54] ELECTROPHOTOCOPIER CHARGING AND TRANSFER ROLLER

[75] Inventor: James E. Genthe, Southbury, Conn.

[73] Assignee: Pitney Bowes Inc., Stamford, Conn.

[21] Appl. No.: 200,114

[22] Filed: Oct. 24, 1980

[51] Int. Cl.[3] ..... G03G 15/02; G03G 15/14

[52] U.S. Cl. ..... 355/3 CH; 355/3 TR; 355/14 CH; 361/221

[58] Field of Search ..... 355/3 R, 3 TR, 3 CH, 355/14 CH, 14 TR; 361/221

[56] References Cited

U.S. PATENT DOCUMENTS

| | | | |
|---|---|---|---|
| 3,854,974 | 12/1974 | Sato et al. | 355/3 TR X |
| 3,936,170 | 2/1976 | Shibano et al. | 361/221 X |
| 3,978,268 | 8/1976 | Kameda et al. | 355/3 TE X |
| 4,260,236 | 4/1981 | Tsuda et al. | 355/3 TR |

OTHER PUBLICATIONS

Noto, Fedele A.; "Copier with Single Corona Generating Device"; Xerox Disclosure Journal; vol. 1, No. 2, Feb. 1976, p. 93.

*Primary Examiner*—Fred L. Braun

*Attorney, Agent, or Firm*—Lawrence E. Sklar; William D. Soltow, Jr.; Albert W. Scribner

[57] ABSTRACT

A photoconductive surface, a carbon loaded, elastomeric roller having two levels of impedance under two distinct loading conditions situated adjacent the photoconductive surface, and a device for generating two different loading conditions on the roller to thereby produce the two levels of impedance, wherein when the roller is subjected to the lower level of loading the roller is operable for charging the photoconductive surface and when the roller is subjected to the higher level of loading the roller is operable for transferring a developed image from the photoconductive surface to a receiver sheet.

8 Claims, 2 Drawing Figures

ELECTROPHOTOCOPIER CHARGING AND TRANSFER ROLLER

BACKGROUND OF THE INVENTION

The instant invention relates to electrophotocopying machines in general and more particularly to rollers used for charging the photoconductor and transferring the developed image from the photoconductor to a receiver sheet in such machines.

Numerous prior art teachings in the field of electrophotographic copying disclose various methods and devices for charging the surface of a photoconductor so as to obtain a latent image from an original document on the photoconductor and for transferring the developed image from the photoconductor to a receiver sheet such as a plain copy sheet. To enable the development of the latent image on the photoconductor and the transferring of the latent image to a receiver sheet, several stations are arranged in proximity to and cooperate with the photoconductor to perform certain functions. At the charging station the photoconductor is charged to a selective polarity, be it positive or negative. The photoconductor then moves to the exposing or imaging station where a latent image is copied from the original document. Next, the electrostatic latent image is developed at a developer station to form a toned image on the photoconductor. The toned image is then transferred from the photoconductor to a receiver sheet at the transferring station. To complete the cycle, the photoconductor is erased and cleaned preparatory to another cycle.

One of the commonly employed techniques of applying an electrostatic charge on the photoconductor and of transferring the developed image is through the use of a corona discharge system. Among the disadvantages of the corona are the generation of appreciable amounts of ozone, the high voltages required, the high power required, the variability of charge applied as a function of ambient conditions and in particular as a function of humidity, and the substantial amount of servicing required for the corona. For these reasons, it is known to substitute for the corona two conductive rollers, one of which has an insulating sleeve on it. A voltage is applied between the two rollers and results in a small current flow across the high resistance sleeve, thereby applying an electrostatic charge to the paper passed between the rollers. These rollers are in contact with one another and for this reason are generally used with coated copy papers which double as the photoconductor and receiver sheet and which can be fed between the rollers. A pair of conductive rollers obviously is not suited for use with plain paper copiers wherein the photoconductor is mounted on a drum or comprises an endless web.

Perhaps one of the most pressing problems associated with conductive rollers is the fact that the charging and transferring functions are performed by separate pairs of rollers at separate stations. Another problem relating to the separate processing stations is the fact that each of the separate pairs of rollers requires a separate power supply. With this type of design, the cost of a plain paper electrophotocopying device is relatively high, due to the individual cost of each roller and power supply. Accordingly, any reduction in the number of rollers and power supplies will reduce the cost of the device.

The foregoing problems are overcome by the instant invention which provides only a single conductive roller which is capable of both charging a photoconductor and transferring the toned image from the photoconductor to a plain copy sheet. The invention is particularly applicable for image retention on the photoconductor when it is desired to make multiple copies on plain paper of a single original document.

SUMMARY OF THE INVENTION

The instant invention provides, in combination, a photoconductive surface, a carbon loaded, elastomeric roller having two levels of impedance under two distinct loading conditions situated adjacent said photoconductive surface, and means for generating two different loading conditions on said roller to thereby produce said two levels of impedance, wherein when said roller is subjected to the lower level of loading said roller is operable for charging said photoconductive surface and when said roller is subjected to the higher level of loading said roller is operable for transferring a developed image from said photoconductive surface to a receiver sheet.

DETAILED DESCRIPTION

Figure 1:
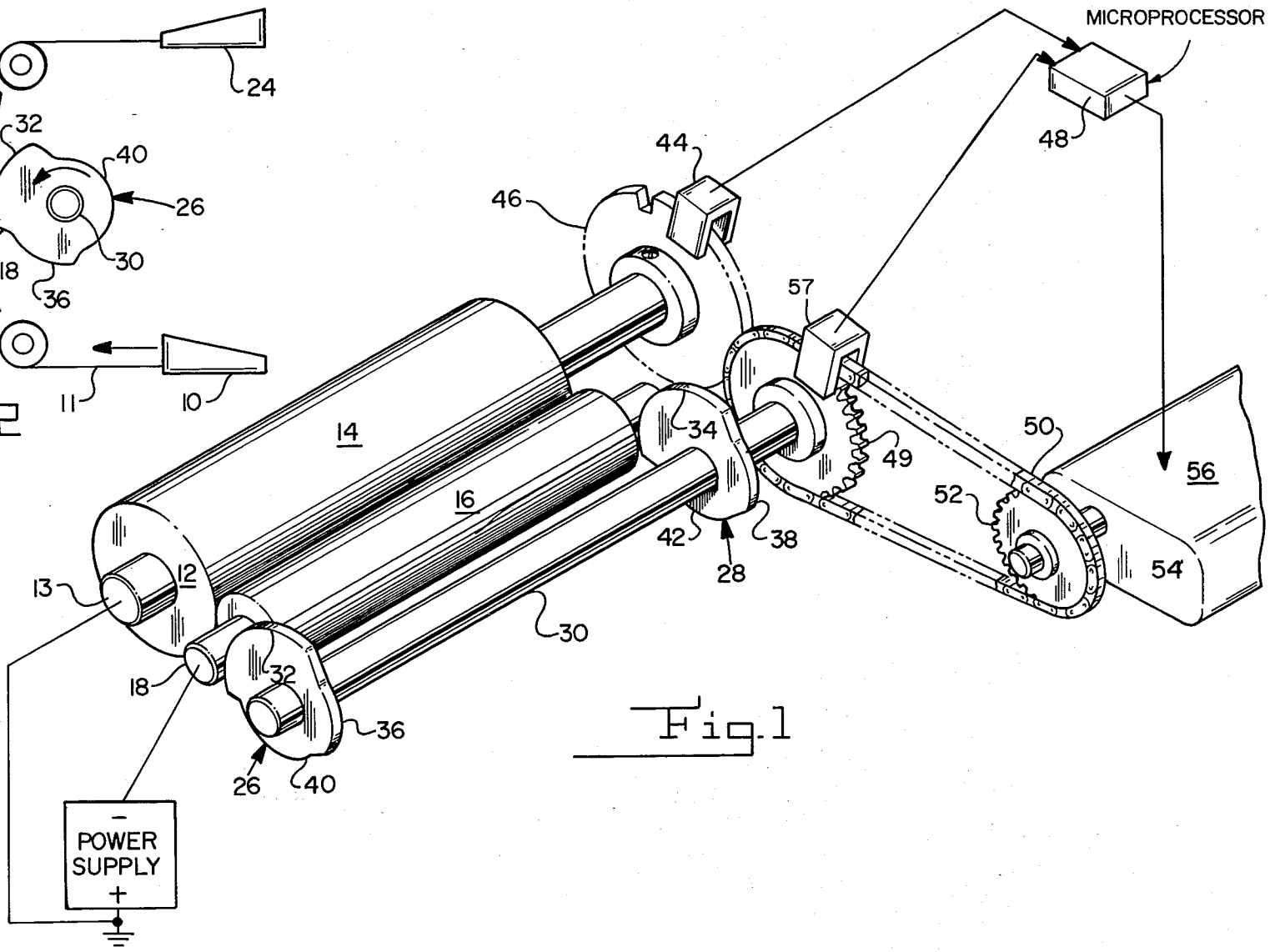
FIG. 1 is a perspective view of a charging and transfer roller in accordance with the instant invention.
Figure 2:
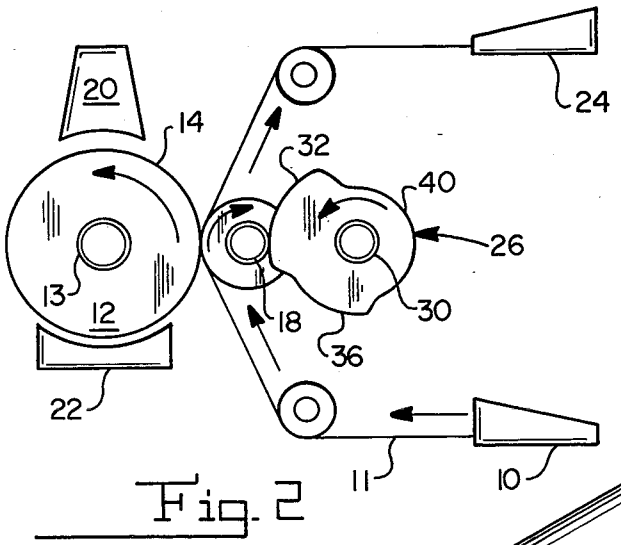
FIG. 2 is a schematic, side elevational view of the roller shown in FIG. 1 together with other elements comprising an electrophotocopy machine.

In describing the preferred embodiment of the instant invention, reference is made to the drawings, wherein there is seen in FIG. 2 a paper supply tray 10 for an electrophotocopying machine (not shown) appropriately designed for feeding by means not shown plain copy sheets along a paper path 11 to the juncture of a steel drum 12 fixedly mounted on a steel shaft 13 and supporting a photoconductor 14 and an elastomeric charging/transfer roller 16 formed from a carbon loaded elastomer rotatably mounted on a steel shaft 18. The elastomeric roller 16 is electrically connected to a D.C. power supply as shown in FIG. 1. The electrophotocopying machine includes an optic system generally designated 20 for scan exposing an original document (not shown) whereby a latent electrostatic image is formed on the photoconductor 14 which subsequently is developed into a toned image by means of a magnetic brush developer apparatus generally designated 22. The developed image is then transferred (as explained hereinbelow) and fixed to the plain copy sheet by a fusing apparatus (not shown). The copy sheet is then fed (by means not shown) into a copy paper tray 24 where it may be retrieved by the operator.

As best seen in FIG. 1 the roller shaft 18 is engaged at its end by two-lobe cams 26 and 28 fixedly mounted on a shaft 30. It is known that as the compressive force on a carbon loaded elastomer is increased, the impedance of the elastomer increases. The higher lobes 32 and 34 of the cams 26 and 28 respectively are thus caused to engage the roller shaft 18 when it is desired to operate the elastomeric roller 16 in a transfer mode, and the lower lobes 36 and 38 of the cams 26 and 28 respectively are caused to engage the roller shaft 18 when it is desired to operate the elastomeric roller 16 in a charging mode, because the charging mode requires a higher charge level and hence a higher level of current than the transfer mode. The cams 26 and 28 also include non-contact portions 40 and 42 respectively which are rotated into a position adjacent the roller shaft 18 when the elastomeric roller 16 is not being employed in one of its two modes, i.e. after transfer and prior to charging.

A drum position sensor 44 (see FIG. 1) is situated adjacent a disk 46 fixedly mounted on the photoconductor shaft 13 in order to sense the rotational position of the photoconductor 14 and to relay such position to a control means 48 such as a microprocessor. The cam shaft 30 is intermittently driven by a sprocket wheel 49 fixedly mounted at one end of the cam shaft 30. The sprocket wheel 49 is driven by a drive chain 50 which runs off a second sprocket wheel 52 fixedly mounted on a drive shaft 54 of a stepper motor 56. A roller position sensor 57 is situated adjacent the sprocket wheel 49 to sense the position of the cam shaft 30 and to relay such position to the control 48. Input to the stepper motor 56 from the control 48 effects the intermittent driving of the cam shaft 30.

In the course of making a single copy of an original document, the photoconductor 14 moves through two revolutions. In the first revolution the photoconductor 14 is charged by the charging/transfer roller 16 operating in its charging moe and exposed at the optic system 20 to generate a latent electrostatic image, which is then developed by the developer apparatus 22. On the second revolution of the photoconductor 14, the developed image is transferred to a plain paper copy sheet by the charging/transfer roller 16 operating in its transfer mode. The unfixed image on the copy sheet is then fixed to the copy sheet by fixing apparatus (not shown). After the developed image is transferred, a residual latent electrostatic image and some untransferred toner remain on the photoconductor 14. Conventional discharge means (not shown) are employed to neutralize any charge on the untransferred toner, and light from an illumination device (not shown) illuminates the photoconductor 14, thereby discharging the residual latent image areas of the photoconductor 14 and thereby erasing any remaining residual electrostatic image. By virtue of the effects of the illumination device and discharge means, the untransferred toner is now only loosely adhering to the photoconductor 14. As the untransferred toner passes the magnetic brush of the developer apparatus 22, the latter attracts the untransferred toner from the photoconductor 14 onto the magnetic brush. Thus, after the second cycle, the photoconductor 14 is cleaned of toner and ready to make another copy.

Prior to the elastomeric charging/transfer roller 16 charging the photoconductor 14, the control 48 causes the stepper motor 56 to rotate the cam shaft 30 which in turn rotates the lower lobes 36 and 38 of the cams 26 and 28 respectively into engagement with the roller shaft 18. The stepper motor 56 is then stopped by the control 48 and the lower lobes 36 and 38 exert a low level load during the first revolution of the photoconductor 14 against the roller shaft 18, which in turn effects a low level pressure and low level impedance in the elastomeric roller 16. The low level impedance permits a high level current to flow from the D.C. power supply through the elastomeric roller 16 sufficient to allow the roller 16 to charge the photoconductor 14.

Once the charging of the photoconductor 14 is completed, and the photoconductor 14 has completed one revolution, the control 48 causes the stepper motor 56 to rotate the cam shaft 30 to a position in which the higher lobes 32 and 34 of the cams 26 and 28 respectively engage the roller shaft 18. The stepper motor 56 is then stopped by the control 48 and the higher lobes 32 and 34 exert a high level load against the roller shaft 18, which in turn effects a high level pressure and high level impedance in the elastomeric roller 16. The high level impedance permits a low level current to flow from the D.C. power supply through the elastomeric roller sufficient to effect the transfer of the developed image on the photoconductor 14 to the plain paper copy sheet. When the transfer process is completed, and the photoconductor 14 is still in its second revolution, the control 48 causes the stepper motor 56 to rotate the cam shaft 30 to a position in which the non-contact portions 40 and 42 of the cams 26 and 28 respectively are situated adjacent but spaced from the roller shaft 18.

In multi-copy mode and with image retention techniques, a first cycle of the photoconductor 14 is required for the charging and image development phase. In subsequent copy cycles, only the functions of development and transfer are required, i.e. charge, expose, develop, transfer, develop, transfer, develop, transfer . . . clean.

The exemplary embodiments described herein are presently considered to be preferred; however, it is contemplated that further variations and modifications within the purview of those skilled in the art can be made herein. The following claims are intended to cover all such variations and modifications as fall within the true spirit and scope of the invention.

What is claimed is:

1. In combination, a photoconductive surface, a carbon loaded, elastomeric roller having two levels of impedance under two distinct loading conditions situated adjacent said photoconductive surface, and means for generating two different loading conditions on said roller to thereby produce said two levels of impedance, wherein when said roller is subjected to the lower level of loading said roller is operable for charging said photoconductive surface and when said roller is subjected to the higher level of loading said roller is operable for transferring a developed image from said photoconductive surface to a receiver sheet.

2. The combination of claim 1, wherein the load generating means comprises a cam having a non-contact area, a lower lobe for the charging function, and a higher lobe for the transfer function.

3. The combination of claim 2, further comprising means for intermittently driving said cam.

4. The combination of claim 3, further comprising means for controlling said intermittent driving means.

5. The combination of claim 4, further comprising means electrically connected to said controlling means for sensing the rotational position of the photoconductive surface.

6. The combination of claim 5, wherein said photoconductive surface is mounted on a drum.

7. The combination of claim 6, further comprising means electrically connected to said controlling means for sensing the position of said cam.

8. The combination of claim 1, wherein the load generating means comprises a pair of cams situated at either end of the roller adjacent the shaft supporting said roller, each of said cams having a non-contact area, a lower lobe engageable with said shaft for the charging function and a higher lobe engageable with said shaft for the transfer function.

* * * * *